US005899150A

United States Patent [19]

Martin et al.

[11] Patent Number: 5,899,150

[45] Date of Patent: May 4, 1999

[54] GRATE ELEMENT AND GRATE WITH FLUID COOLING

[75] Inventors: Johannes Josef Edmund Martin, München; Thomas Nikolaus, Radolfzell, both of Germany

[73] Assignees: Martin GmbH, Munich; Techform Engineering GmbH, Radolfzell, both of Germany

[21] Appl. No.: 08/866,432

[22] Filed: May 30, 1997

[30] Foreign Application Priority Data

Jun. 4, 1996 [DE] Germany ..... 196 22 424

[51] Int. Cl.[6] ..... F23K 3/08; F23H 3/00; F23N 5/02

[52] U.S. Cl. ..... 110/268; 110/298; 110/299; 110/328; 110/188; 110/190; 126/163 R; 126/152 R; 165/168; 165/169; 165/172; 165/173

[58] Field of Search ..... 165/168, 169, 165/171, 172, 173; 110/268, 188, 248, 255, 269, 270, 278, 281, 298, 299, 328, 329, 190; 126/152 B, 152 R, 163 R, 176 R, 174, 175, 179, 155, 167; 122/232, 371, 374, 375, 376

[56] References Cited

U.S. PATENT DOCUMENTS

| | | | |
|---|---|---|---|
| 667,607 | 2/1901 | Thurell | 122/375 |
| 828,769 | 8/1906 | Parkison | 122/374 |
| 879,492 | 2/1908 | Richardson | 122/374 |
| 1,170,317 | 2/1916 | Nye | 122/374 |
| 1,438,190 | 12/1922 | Skelly | 110/281 |
| 1,775,790 | 9/1930 | Tawlks | 122/374 |
| 2,745,364 | 5/1956 | Martin | 110/298 |
| 4,510,873 | 4/1985 | Shigaki | 110/289 |
| 5,302,119 | 4/1994 | Bartoletto et al. | 432/77 |
| 5,724,898 | 3/1998 | Von Bockh et al. | 110/291 |

FOREIGN PATENT DOCUMENTS

| | | |
|---|---|---|
| 2138666 | 10/1994 | Canada . |
| 2140218 | 7/1995 | Canada . |
| 0621449 A1 | 10/1994 | European Pat. Off. . |
| 515691 | 12/1953 | Germany . |
| 4400992 C1 | 5/1995 | Germany . |

*Primary Examiner*—Ira S. Lazarus
*Assistant Examiner*—Ljiljana V. Ciric
*Attorney, Agent, or Firm*—Wood, Herron & Evans, L.L.P.

[57] ABSTRACT

The grate element (1, 2) is made in three pieces in the sample embodiment, and consists of a central main part (10) and two side parts (11, 12) attached thereto. The main part (10) is pierced by parallel straight-line bores, which form the straight-line conduit sections. These straight-line conduit sections (13) are flow-connected with reversers (14) in the respective side parts (11, 12). The inlet (15) for the coolant fluid is located in the rear part of the grate element, whereas the outlet (16) is located in the head area (7) of the grate element. In the outlet (16) there is a temperature probe (17) for monitoring the temperature of the coolant fluid. The grate element head (7) has recesses (18) in its foot (8) which open downward, serving as air escape orifices for the primary air, which is supplied from beneath.

15 Claims, 1 Drawing Sheet

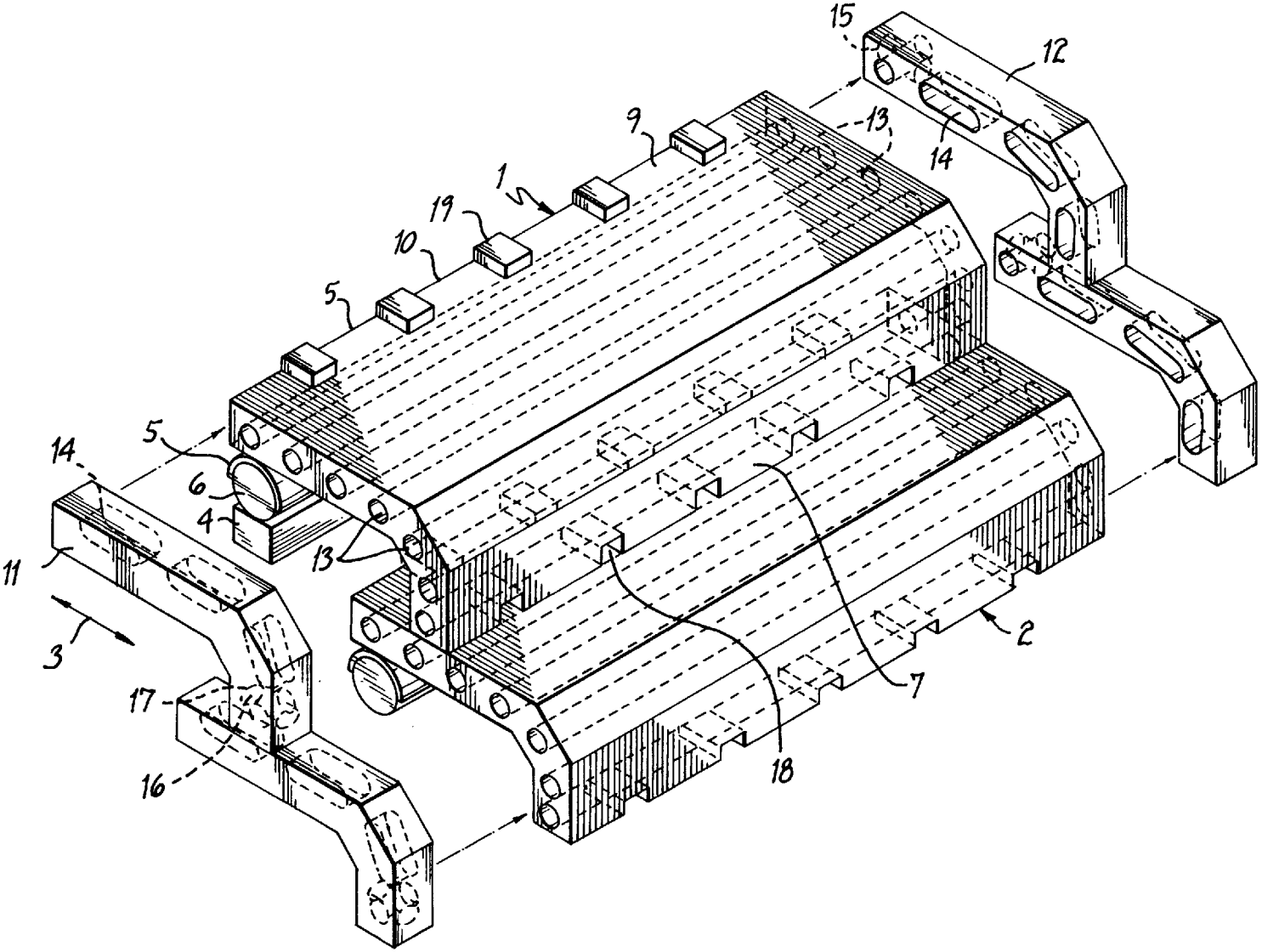
12
15
13
14
9
1
19
10
5
2
7
18
13
6
4
5
14
11
3
17
16

GRATE ELEMENT AND GRATE WITH FLUID COOLING

FIELD OF THE INVENTION

The present invention relates to a waste incinerator grate element with fluid cooling, with at least one conduit for carrying the fluid, with parallel sections, and with a fluid inlet and a fluid outlet. The invention also relates to a grate constructed of such grate elements.

BACKGROUND OF THE INVENTION

Grate elements of a grate consisting of grating stages which overlap like roof tiles and which can move relative to each other, which are constructed of one or more grate elements lying adjacent to each other, are subjected to high and widely varying heat demands, a high degree of mechanical abrasion, and chemical attacks. The wearing of a grate element depends to a great degree on the heat demands, so that in recent times fluid-cooled grate elements have been introduced, since fluid cooling is expected to provide better cooling and a more even temperature distribution within the grate element.

From European Patent A-0 621 449 a plate-shaped grate element is known which is executed as a hollow body of sheet metal, and which has an inlet and an outlet for cooling water. With this known grate element it is also possible to provide baffles in the hollow body in order to force the cooling water to flow through the grate element in an indirect path. The inlet and outlet are placed in the area of the attachment or drive end of the grate element. With a grate element constructed in this way there are very large flow profiles and associated dead spaces, flow interruptions, and irregular distributions of the cooling fluid. In addition, such grate elements cannot be adequately vented, so that rather large accumulations of air can form, which lead to significantly poorer cooling in this area and hence to overheating of the grate element. This is particularly detrimental when the grate elements are deployed in a reverse pusher grate, where the grate element heads are located at a higher position than the respective attachment or drive end of the grate element due to the inclined installation position. With such an installation position, the air which is present in the grate element then collects in the head area of the grate element, which is in principle subjected to greater heat demands, independently of the type of grate, so that in combination with the poorer cooling effect brought about by air bubbles the wearing of the grate element rises sharply. Furthermore, the grate elements which are in the form of hollow sheet metal bodies can warp under uneven cooling and thereby lead to malfunctions in the operation of the grate. The deployment of the inlet and outlet for the cooling fluid in the rear area of the grate element, i.e. in the vicinity of the attachment or drive end, leads to unsatisfactory reading of the coolant temperature, since the inlet and outlet locations are in the cooler area and it is practical to apply temperature probes to the outlet. The problems of overheating due to air bubbles, explained earlier, especially in the area of the head, can therefore not be recognized adequately.

From German Patent C-44 00 992 a fluid-cooled grate bar is known which has at least one conduit, the sections of which run parallel to each other in the longitudinal direction of the grate bar and are connected with a reverser in the head area of the grate bar. The inlet and outlet for this conduit are in the rear area for this known grate bar as well, i.e. in the area of the attachment or drive end, so that here again basically similar disadvantages occur as in the case of the plate-shaped grate element which was mentioned first. With this known grate element too, which has a conduit with a substantially rectangular cross section and a folding course for changing the direction in the area of the head, flow interruptions or eddies and air accumulations cannot be avoided with certainty. Since in addition to the inlet the outlet is also deployed in the rear area of the grate bar, not only is the reading of the temperature inadequate, as already described, but also venting, that is the removal of any bubbles which may have formed in the head area, turns out to be extremely difficult.

The object of the invention is to design a grate element with fluid cooling of the type indicated above in such a way that an intended cooling of the grate element, adapted to the particular circumstances, can be achieved with little engineering effort and expense for control technology.

SUMMARY OF THE INVENTION

This object is accomplished under the present invention, on the basis of a grate element of the type described at the beginning, by having the parallel sections of the conduit run transversely to the longitudinal direction of the grate element, and hence transversely to the direction in which the material to be incinerated is transported, and by having the conduit sections run in straight lines, with a cross section which leads to a compact and uninterrupted flow which is free of dead zones.

By configuring the conduit sections transversely to the longitudinal direction of the grate element, in combination with small cross sections, the danger of an accumulation of air bubbles or steam bubbles is avoided, since all of the sections of a conduit are at the same height. This avoids higher-lying cavities, which may not necessarily be flushed, and in which air bubbles can collect, whereas the selection of a small cross section produces a compact and uninterrupted flow, free of dead zones, in the entire cross section, which leads to better elimination of any air bubbles which may form than if there were a non-homogeneous flow with dead zones in large chambers. In consideration of the need for disposal of heat, a Reynold's number higher than 10,000 is set.

One advantageous embodiment provides for the connection of two straight-line conduit sections by a reverser, so that the fluid can flow through them in series, and provides for the fluid inlet to be in the area of the attachment or drive end and for the fluid outlet to be in the head area of the grate element. By locating the fluid inlet at the rear, cooler end of the grate element, and by locating the fluid outlet in the head area, i.e. at the hotter end of the grate element, there occurs a temperature increase of the coolant corresponding to the temperature increase which occurs in the longitudinal direction of the grate element, so that the coolant, which is growing warmer, is conducted away after it reaches its highest temperature at the hottest point in the grate bar, which provides the prerequisite for a reading of the temperature of the grate element which is in accordance with the actual conditions. A significant advantage consists in the fact that with this deployment of the inlet and outlet, in combination with the transverse flow-through of the grate element explained earlier, the temperature distribution in the grate element at a particular location in the cross section is largely uniform, which means that variations in temperature between the two flanks of a grate element are avoided. This is especially advantageous in the case of those grate elements which extend across the entire width of the grate, so that they have a very long path for the coolant. In the case of the known plate-shaped grate element, where the cooler inlet is located on the one side and the much warmer outlet is on the other side, that edge area of the grate element corresponding to the outlet will be warmer than the edge or flank area of the grate element corresponding to the inlet. In the case of grate elements which are very broad and consist of hollow sheet metal bodies, this can lead to twisting of the grate element. Such manifestations are avoided by means of the embodiment in accordance with the present invention.

It is also possible, however, for all of the conduit sections to have a common fluid inlet and a common fluid outlet, so that the fluid can flow through them in parallel.

One advantageous embodiment consists in having the conduit sections have a circular cross section with a diameter of 5 to 25 mm.

In the case of cross sections which deviate from round, it is advantageous for the conduit sections to have a small cross section of 20 to 500 $mm^2$.

A preferred embodiment of the invention consists in having the grate element consist of a solid, pressure-resistant plate-shaped main part and narrow, solid, pressure-resistant side parts which are attached on both sides, with the main part containing the straight-line conduit sections and the side parts containing the reversers. This embodiment makes it possible to manufacture the main part of the grate element out of a solid steel plate by drilling suitable bores clear through, where the attached side parts contain the reversers. Here the side parts can be cast in single pieces or manufactured in two parts from rolled steel, with the reversers produced for example by routing, which makes it possible to produce reversers with especially smooth inner walls. With regard to optimally compact and interruption-free flow without dead zones, it is advantageous for the entire conduit to have a smooth inner wall produced by fine processing, which can be accomplished by producing the straight-line conduit sections by boring and the reversers by routing.

In order to allow for the varying temperature distribution in the longitudinal direction of the grate element, i.e. in the direction from the connection or drive end to the head end, the intervals between the conduit sections can be smallest in the head area and larger in the direction of the attachment or drive end.

If, in a further refinement of the invention, there is a temperature probe placed at the outlet to regulate the coolant temperature by changing the velocity of flow and/or the pressure of the coolant, then especially fine regulating can be performed because of the fact that the outlet is in the head area, i.e. in the hottest area of the grate bar, since with this configuration the hottest temperature of the coolant and of the grate bar can be read. That is not possible with the same precision when the outlet is located at the backward end of the grate element. It is necessary to change the pressure of the coolant in a closed-circuit system in the vicinity of the boiling temperature of the coolant, in order to raise the pressure to avoid steam bubbles. Placing a temperature probe in the outlet has the advantage that the necessary inlet line can be routed for example inside the outlet line for the coolant, which offers especially good protection for this inlet line. Exposed inlet lines leading to temperature probes on grate bars are often subject to the danger of being destroyed in this rough operation.

Because of the conduit sections which run transversely to the longitudinal direction of the grate element, which are straight-lined and which cause no loops in the head area, provision can be made in the head area for air escape orifices for the primary combustion air, which is fed from beneath the firing grate formed of overlapping grate elements, without the need of making any special provisions for the formation of such air escape orifices.

A grate for combustion plants, with grating stages lined up sequentially in the direction of transport of the material to be incinerated, overlapping each other like roof tiles, and alternately movable and stationary, which is constructed of individual grate elements extending across the entire width of the grate or of multiple grate elements lying side-by-side further is characterized by the fact that each grating stage is assigned to its own regulatable fluid coolant circuit. In the event that each grating stage is constructed of multiple grate elements, the coolant fluid can flow through them either in series or in parallel.

An especially favorable option for regulating the temperature of the coolant, and hence of the grate element, results from the fact that when there are multiple grate elements in a grating stage, each grate element is assigned to its own regulatable fluid coolant circuit.

To simplify the construction effort, and especially the effort in regulating technology, provision is made for at least two grating stages in a row to be assigned to their own coolant circuit.

BRIEF DESCRIPTION OF THE DRAWINGS

The invention is explained in further detail below on the basis of a sample embodiment shown in the drawing, whose only FIGURE shows a graphic representation of two grate elements which overlap like roof tiles in accordance with the invention.

DETAILED DESCRIPTION OF THE DRAWING

As can be seen from the drawing, a grate is constructed of a plurality of grate elements 1 and 2 which overlap each other like roof tiles, of which the grate elements 1 can be moved back and forth in the direction of the double arrow 3 and the grate elements 2 are stationary. The grate elements 1 are assigned to a drive mechanism 4 which produces the necessary stroke. Each grate has an attachment or drive end 5, which is hooked into a holder 6, with this holder 6 firmly connected to the drive mechanism in the case of the driven grate elements. In addition, each grate element has a head end 7 and a back 9.

In the embodiment represented in the drawing, each grate element 1 or 2 is constructed in three parts, and consists of a main part 10 and two side parts 11 and 12. The main part 10 consists of a solid, pressure-resistant plate which is pierced by straight bores 13 which run parallel to each other and transverse to the longitudinal direction, i.e. transverse to the direction in which the material to be incinerated is transported; these form the straight-line conduit sections for the coolant. In the side parts 11 and 12 there are reversers 14, where each reverser is assigned to two adjacent conduit sections 13. The first reverser, which is in the rear area of the grate, is connected to an inlet 15, and the last reverser, which is in the head area, is connected to an outlet 16. Thus the coolant enters at the inlet and flows through the individual conduit sections in sequential order, from the rear to the front, in each case parallel to the surface of the grate element and transverse to the longitudinal direction of the grate element, until it exits again in the head area through the outlet 16. In accordance with the temperature distribution in the longitudinal direction of the grate element, i.e. looking from the attachment end or drive end 5 in the direction of the head end 7, the intervals between the individual straight-line conduit sections 13 vary, with the conduit sections in the head area lying considerably closer together than in the backward area of the grate element. This distribution is provided in order to allow for the higher heat demands on the grate element in the head area. The reference number 17 designates a temperature probe for reading the temperature of the coolant at the outlet 16. The number 18 identifies air escape orifices in the form of recesses opening downward at the foot of each grate element, so as to be able to conduct the primary combustion air, which is supplied from below, to the fuel which is lying on the grate elements. These air escape orifices are cleansed of jammed particles by means of cleaning projections 19, which are provided in the rear area of the grate element back 9, when the longest stroke is set.

The drawing shows exploded views of the side parts 11 and 12 in addition to the main part 10. With the operationally ready grate element, these side parts are firmly connected with the main part 10; this can be done for example by means of screws, which are not shown. To achieve the smoothest possible inside surface of the reversers 14, the side parts 11 and 12 can be made in pieces so that the reversers 14 can be produced for example by routing.

Although the present application describes and illustrates a preferred embodiment of the invention, applicants do not intend to be limited thereby. Those skilled in the art will readily appreciate that the advantages of the invention can be achieved via various modifications or variations from the specific details shown and described in the present application. Therefore, applicants intend only to be bound by the following claims, as set forth below.

We claim:

1. In a waste incinerator having at least two grate elements arranged in overlapping relationship along a first direction, the first direction being the direction in which material for incineration is to be transported, wherein at least one of the grate elements includes a fluid cooling conduit with at least two parallel sections, each of the parallel sections including a pair of outermost ends, the fluid cooling conduit having a fluid inlet and a fluid outlet, said grate element further comprising:

a main body, said at least two parallel sections extending along the main body in straight lines and oriented transverse to the first direction; and a pair of side caps secured to opposite sides of the main body to cover the outermost ends of the at least two parallel sections of the fluid cooling conduit, the side caps further defining the fluid inlet and the fluid outlet and at least one of the side caps including a reverser for interconnecting, in series, two outermost ends of a pair of said at least two parallel sections, said pair residing adjacent each other.

2. The invention of claim 1 wherein said grate element includes a plurality of parallel sections, the fluid inlet is located at a drive end of the grate element and the fluid outlet is located at an opposite head end, each of the side caps further comprising at least one reverser, each of the outermost ends of the parallel sections terminating at one of the following: a reverser, the fluid outlet, and the fluid inlet, so that fluid may flow into the fluid inlet at the drive end and then sequentially through all of the parallel sections and eventually out of the fluid outlet at the head end.

3. The invention of claim 1 wherein each of said parallel sections of said grate element is circular in transverse cross section, with a diameter of 5 mm to 25 mm.

4. The invention of claim 1 wherein each of said parallel sections of said element has a transverse cross-sectional area of 20 $mm^2$ to 500 $mm^2$.

5. The invention of claim 1 wherein each of said parallel sections of said grate element comprises a bore extending through the main body.

6. The invention of claim 1 wherein each of said parallel sections of said grate element has a relatively smooth interior wall, thereby to promote interruption-free fluid flow along the fluid cooling conduit.

7. The invention of claim 2 wherein the parallel sections are spaced more closely to each other at the head end of the grate element and then at the drive end.

8. The invention of claim 1 wherein said grate element further comprises a temperature probe located at the fluid outlet to sense the temperature of coolant exiting the fluid cooling conduit, thereby to facilitate regulation of the temperature of the coolant by changing at least one of the flow rate and the pressure of the coolant.

9. The invention of claim 1 wherein each of said at least two grate elements is step-like in shape and has a bottom edge with a plurality of spaced escape orifices formed in said edge and oriented parallel with the first direction, the orifices adapted to promote fluid flow along said first direction.

10. The invention of claim 1 and further comprising a plurality of grate elements arranged in step-like overlapping stages along the first direction, wherein alternate stages of the grate elements are, respectively, movable and stationary and each stage has a corresponding fluid cooling conduit, thereby to enable independent regulation of the fluid coolant flow in each stage.

11. The invention of claim 10 wherein each stage includes a plurality of main bodies arranged side by side.

12. The invention of claim 11, characterized in that each of the grate elements of each grating stage has a corresponding regulatable fluid coolant circuit.

13. The invention of claim 11, characterized in that at least two successive grating stages are assigned to a single fluid coolant circuit.

14. A fluid-cooled grate element having a fluid cooling conduit for conveying cooling fluid, the conduit having at least two parallel sections and a fluid inlet and a fluid outlet, each of the parallel sections having outermost ends located adjacent opposing end walls of the grate element, the grate element adapted to be arranged with other like grate elements in step-like fashion along a first direction in which material to be incinerated is transported, wherein the parallel sections extend transverse to the first direction and in straight lines and each of the parallel sections has a transverse cross-sectional area which promotes interruption-free flow of fluid through said area grate element further including:

a pressure-resistant main body and a pair of pressure-resistant side pieces attached on opposing sides of the main body to define the end walls of the grate element, each of the side pieces having at least one reverser for interconnecting a pair of outermost ends of adjacently located parallel sections, each of the transverse cross sectional areas being in the range of 20 $mm^2$ to 500 $mm^2$.

15. A fluid cooled grate element having a fluid cooling conduit for conveying cooling fluid, the conduit having at least two parallel sections and a fluid inlet and a fluid outlet, each of the parallel sections having outermost ends located adjacent opposing end walls of the grate element, the grate element adapted to be arranged with other like grate elements in step-like fashion along a first direction in which material to be incinerated is transported, wherein the parallel sections extend transverse to the first direction and in straight lines and each of the parallel sections has a transverse cross sectional area which promotes interruption-free flow of fluid through said area grate element further including:

a pressure-resistant main body and a pair of pressure-resistant side pieces attached on opposing sides of the main body to define the end walls of the grate element, each of the side pieces having at least one reverser for interconnecting a pair of outermost ends of adjacently located parallel sections; and a temperature probe at the fluid outlet for regulating the coolant temperature.

* * * * *